US005497704A

United States Patent [19]

Kurschner et al.

[11] Patent Number: 5,497,704

[45] Date of Patent: Mar. 12, 1996

[54] MULTIFUNCTIONAL MAGNETIC FUZE

[75] Inventors: Dennis L. Kurschner, Minnetonka; David P. Erdmann, Hopkins; Scott D. Crist, Minnetonka, all of Minn.

[73] Assignee: Alliant Techsystems Inc., Hopkins, Minn.

[21] Appl. No.: 176,355

[22] Filed: Dec. 30, 1993

[51] Int. Cl.[6] ..... F42C 11/04; F42C 9/14

[52] U.S. Cl. ..... 102/264; 102/266; 102/215; 102/212; 102/216; 89/6.5

[58] Field of Search ..... 102/264, 262, 102/265, 266, 212, 216, 215; 89/6.5, 6

[56] References Cited

U.S. PATENT DOCUMENTS

| | | | |
|---|---|---|---|
| 3,353,487 | 11/1967 | Perryman | 102/215 |
| 3,622,987 | 11/1971 | Borkan | 340/146.2 |
| 3,814,017 | 6/1974 | Backstein et al. . | |
| 3,853,062 | 12/1974 | Cole | 102/215 |
| 4,022,102 | 5/1977 | Ettel | 89/6.5 |
| 4,142,442 | 3/1979 | Tuten | 89/6.5 |
| 4,144,815 | 3/1979 | Cumming et al. | 102/214 |
| 4,318,342 | 3/1982 | Chandler | 102/207 |
| 4,328,938 | 5/1982 | Reisman et al. | 244/3.1 |
| 4,454,815 | 6/1984 | Beck | 102/206 |
| 4,470,351 | 9/1984 | Favace | 102/262 |
| 4,495,851 | 1/1985 | Koerner et al. | 89/6.5 |
| 4,664,013 | 5/1987 | Wegner et al. | 89/6.5 |
| 4,862,785 | 9/1989 | Ettel et al. | 89/6.5 |
| 5,241,892 | 9/1993 | Ousterhout | 89/6.5 |
| 5,247,866 | 9/1993 | O'Malley | 102/201 |

FOREIGN PATENT DOCUMENTS

| | | | |
|---|---|---|---|
| 0116714 | 8/1984 | European Pat. Off. . | |
| 0348985 | 1/1990 | European Pat. Off. . | |
| 2821529 | 12/1978 | Germany | 102/212 |
| 3935648 | 5/1991 | Germany | 102/212 |
| 1129448 | 5/1967 | United Kingdom . | |

*Primary Examiner*—Stephen M. Johnson
*Attorney, Agent, or Firm*—Vidas, Arrett & Steinkraus

[57] ABSTRACT

A multifunctional magnetic fuze is disclosed. The sensor includes an apparatus and method for counting each rotation of a projectile after firing from a weapon. A signal is generated which indicates the rotations of the projectile and a counter counts the turns so that the projectile may detonate at a predetermined nominal number of turns. The turns count may also be used to calculate spin rate and muzzle velocity so that the nominal turns count may be adjusted based on actual velocity. The fuze also may include a timer for counting a time to burst of a projectile. The turns count and/or the times count may be utilized to provide accurate detonation.

24 Claims, 5 Drawing Sheets

MULTIFUNCTIONAL MAGNETIC FUZE

FIELD OF THE INVENTION

This invention relates to the field of fuzes and more particularly, to an apparatus and method for control of a projectile with fuze functions including magnetically sensing ballistic spin parameters and computing muzzle velocity for accurately controlling range to burst of a projectile.

BACKGROUND OF THE INVENTION

Remote settable fuzes have been used in projectiles for some time. A remote settable fuze allows external information to be input to the projectile before firing. One known method for inputting information to the fuze is by non-contact inductive coupling. This is a transformer approach with the primary of the transformer placed outside the projectile, in what is commonly called a setter, and the secondary of the transformer placed in the fuze. Magnetic flux passes between the primary and secondary with appropriate AC modulation containing data. The information input to the fuze relates to a fuze mode setting or for example, may contain a time-to-burst for the projectile. Time-to-burst represents a predetermined time period after firing, approximating a desired range, after which the projectile detonates.

In a bursting munitions scenario, the most important features of the projectile and its fuze are accuracy and safety to the user. These factors are related to fuze control functions. Previously, systems have used expensive and complicated mechanical and/or electrical methods to try to more accurately determine the range of a projectile and control the fuze. One variable which greatly affects the accuracy of the range determination is the actual muzzle velocity, which can vary depending on a large number of known factors. It has always been desirable to control the detonation of a projectile based on a determination of actual muzzle velocity. However, an accurate system for determining muzzle velocity within a projectile has not been available. Systems mounted directly on the muzzle of specialized guns do exist, but greatly complicate the gun and are contrary to a general standardized approach for all weapons.

Prior systems have depended on time setting and have not been able to accurately predict muzzle velocity. Other fuzing systems require mechanical settings by the user for communicating functions. This dependency on the operator creates a much larger risk of mistake or accident. Other electronic systems have proved to be too costly and require more space in the projectile than is available. Also, some prior solutions use parts, such as crystals, which cannot readily tolerate the forces or shock which the projectile experiences.

Consequently, a need remains for a compact, simple multi functional sensor that acts as a remote receiver and provides more accurate detonation of the projectile.

SUMMARY OF THE INVENTION

This invention is a sensor for a class of projectile fuzes for use in artillery rounds, tank rounds, medium caliber bullets of all sizes, and individually carried combat weapons. The functions inherent in this fuze include those required by present standards and further include several other functions not available with prior art fuzes and are all accomplished with a single magnetic sensor element. In particular, internal turns counting is provided so that a turns-to-burst detonation mode is possible. The revolutions per second or turns of the projectile are counted and the detonation of the projectile is based on this count. Another related function of the invention is the determination of muzzle velocity based on turns counting, which allows for calculation of what has always been an indeterminate measurement. The determination of muzzle velocity allows for compensation of the fire control systems count estimate of the turns-to-burst, which is based on a nominal assumed muzzle velocity, by modifying the turns-to-burst count based on the actual muzzle velocity measurement.

The inventive sensor therefore functions as a remote set receiver, a ballistic turns counter and a muzzle velocity calculator. The present invention eliminates the previously mentioned problems and provides a single sensor internal to the fuze to power the fuze, accurately sense remote settings and modes, provide a count of ballistic turns to determine muzzle velocity, and provide a multitude of functions which lead to accurate and safe deployment of projectiles. The fuze can use the measurement of the actual muzzle velocity to compensate the turns-to-burst count for deviations of the actual muzzle velocity from the assumed nominal muzzle velocity.

The invention comprises an apparatus for counting each rotation of a projectile, after firing the projectile from a firing weapon, the projectile having a longitudinal axis, the apparatus comprising counting means for counting each rotation of the projectile as it rotates around its longitudinal axis. The counting means further includes spin signal means for generating a spin signal which varies over time as the projectile rotates about its axis in the earth's magnetic field and where the magnitude of the spin signal reaches a predetermined threshold a predetermined number of times for each rotation of the projectile and a counter operatively connected to the spin signal means for counting the number of times the spin signal reaches its predetermined threshold.

DETAILED DESCRIPTION OF THE INVENTION

While this invention may be embodied in many different forms, there are described in detail herein specific preferred embodiments of the invention. This description is an exemplification of the principles of the invention and is not intended to limit the invention to the particular embodiments illustrated.

The bursting munition fuze can be categorized as the "remote control" element of a weapons system. Once the projectile leaves the gun, the fuze is the last control on the projectile's functions. Therefore, the fuze is a vital performance link between the initial optimized attributes of the gun and fire control subsystems and the ultimate maximization of the warhead effects. As is well known, the fire control subsystem measures target range, cant, wind, temperature, pressure, and target motion and predicts a gun setting and subsequently communicates a burst range prediction to the fuze based on calculated ballistic parameters.

The ultimate effectiveness of the weapon is directly related to control of errors for the air burst prediction. A commonly employed approach is to convert the target range (from the fire control rangefinder) into a time countdown number based on estimated projectile ballistics. One of the important ballistic characteristics is the nominal muzzle velocity for a particular projectile and gun. A more accurate ballistic prediction could be provided by basing the time countdown on an actual muzzle velocity rather than relying solely on the nominal or assumed muzzle velocity for that class of projectile and gun. The actual muzzle velocity changes with propellant load, propellant density, propellant temperature, and barrel wear and can result in range errors on the order of one hundred meters, when using the nominal muzzle velocity parameter. This range error is unacceptable.

Figure 1:
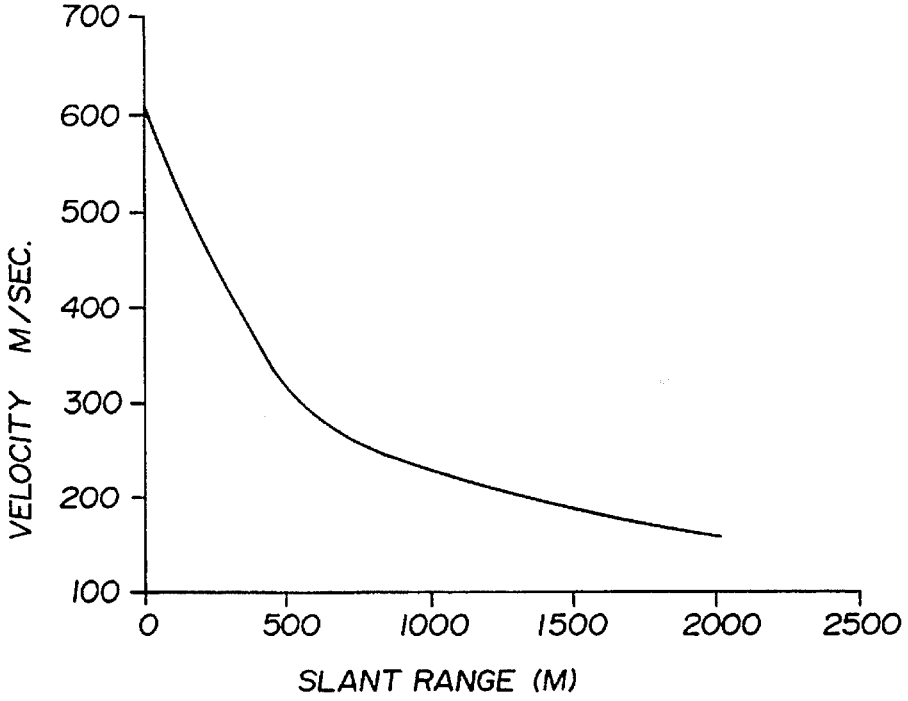
FIG. 1 is a graph illustrating the velocity profile of a 25 mm projectile over a range.

A fuze cannot measure range directly and therefore uses a parameter proportional to range. The prior art time-based measurement concept is derived from the relationship of range being equal to velocity * time. As shown in FIG. 1, for a typical 25 mm projectile, tested at 60° F. and with a nominal muzzle velocity of 617 m/s, the velocity versus range is nonlinear. The curve shifts for different initial muzzle velocities, producing large errors in time-based range prediction.

Figure 2:
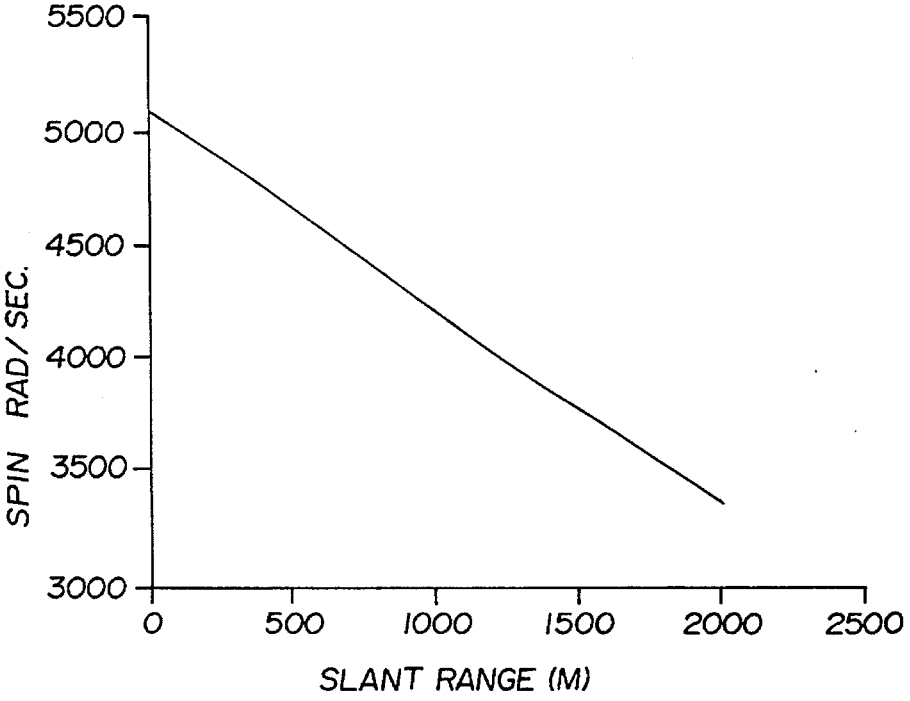
FIG. 2 is a graph illustrating the spin profile of a 25 mm projectile over a range.

Alliant Techsystems has discovered analytically and experimentally that a turns counting base parameter behaves more ideally (more linear) as shown in FIG. 2, which was tested at 60° F. and with a 6° gun twist. As will be discussed more fully below, Alliant Techsystems has discovered that they can use the earth's magnetic field to count the turns of the projectile. From the known gun characteristics and the turns count, the instantaneous spin rate of the projectile can be calculated. The spin profile (spin versus range) shown in FIG. 2 is for a 25 mm projectile and is relatively linear and predictable, producing better prediction performance than time interval measurement. Instantaneous spin rate is an excellent base parameter estimator of a projectile's velocity over a good part of its flight and especially near the muzzle. A turns counting fuze can measure actual muzzle velocity, as will be discussed more fully below, and provide a correction to the turns-to-burst count based on the difference between the nominal and actual muzzle velocity, so that by using down range turns counting it can produce minimal burst error. Although the range determination can be based entirely on a turns count, Alliant Techsystems has discovered that depending on specific ballistic application and range it may be more accurate to utilize both turns counting and time interval counting. For a given fixed muzzle velocity, Alliant Techsystems has discovered that turns performance is much better out to about 1000 m. After this point, the velocity tends toward a terminal value and time performance is somewhat better. Therefore, it is optimal to utilize a fuze having a sensor which continuously measures turns and an algorithm to measure velocity based on turns counting in conjunction with time interval counting. In this manner, a fuze system may employ turns counting at the short and medium ranges, augmented by time prediction at far ranges.

The fuze of the invention provides a unique approach to measure and correct for muzzle velocity. The same sensor that provides for setter communication measures spin rate at muzzle exit which is related to muzzle velocity by barrel twist, as is well known. This same sensor can be used to count turns down range, as the advance ratio is more accurate than time over a significant early portion of total range. The advance ratio equals the turns per unit distance of a projectile due to gun barrel rifling. The sensor allows for real time assessment of muzzle velocity and subsequent down range velocities. This sensor allows combining muzzle velocity, turns, and time to accurately establish a range dependant burst.

The invention uses a magnetic circuit to communicate to the fuze. An inductive setting coil is driven by the fire control electronics with a receiving coil located in the fuze. The receiving coil is coupled to the setting coil by transformer action. Data is modulated onto a carrier signal. The carrier signal is rectified in the fuze and is used to charge a capacitor for storage of fuze system power. The modulation with mode, burst time, and other information is decoded and processed for operational parameter definition.

As described above, the range to burst of a projectile is subject to errors due to various factors. The fire control electronics of a weapon system provide nominal data based on a calculated range to burst or time to burst to the fuze. This data is only as accurate as the projectile characteristics are close to the nominal settings, one of which is the nominal muzzle velocity. Therefore, it is desirable to adjust the range to burst based on actual measurement of the muzzle velocity.

In order to determine muzzle velocity a sensor is employed to count the turns of the projectile. Full or partial turns may be counted, as desired. The sensor is a magnetic transducer which senses the earth's magnetic field. As will be discussed more fully below, based on the characteristics of the gun, spin rate can be determined after a predetermined number of spins have been counted. Spin rate is proportional to muzzle velocity. In this manner, muzzle velocity is determined.

Once muzzle velocity has been determined, the range to burst of the projectile may be adjusted to compensate for a muzzle velocity which is not equal to the nominal value. If the fuze is programmed to detonate after a number of counted turns, the calculated muzzle velocity is compared to the nominal velocity value and the number of turns to burst is adjusted upward or downward to compensate for any variation in velocity. If the measured muzzle velocity is greater than the nominal then the number of turns to burst is decreased to reduce error. If the measured velocity is less than the nominal then the number of turns to burst is increased to reduce error.

Figure 3:
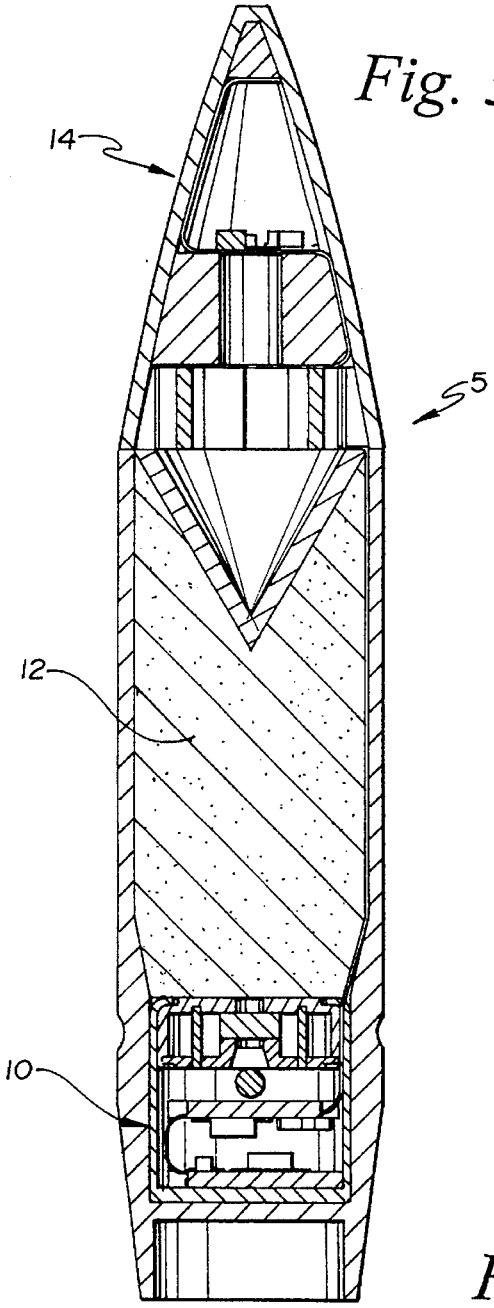
FIG. 3 is a cross section of a projectile which utilizes the invention.

Referring to FIG. 3, a cross section of a projectile 5 is shown. The projectile 5 includes a base element 10, a warhead 12 and a nose element 14. The projectile 5 also contains a fuze 16 (shown in FIG. 4) in the nose element 14 and/or the base element 10. One skilled in the art knows that the fuze may be "packaged" to fit in the nose element 14 and may also be "packaged" to fit in both the nose and base elements 14 and 10, as desired.

Figure 4:
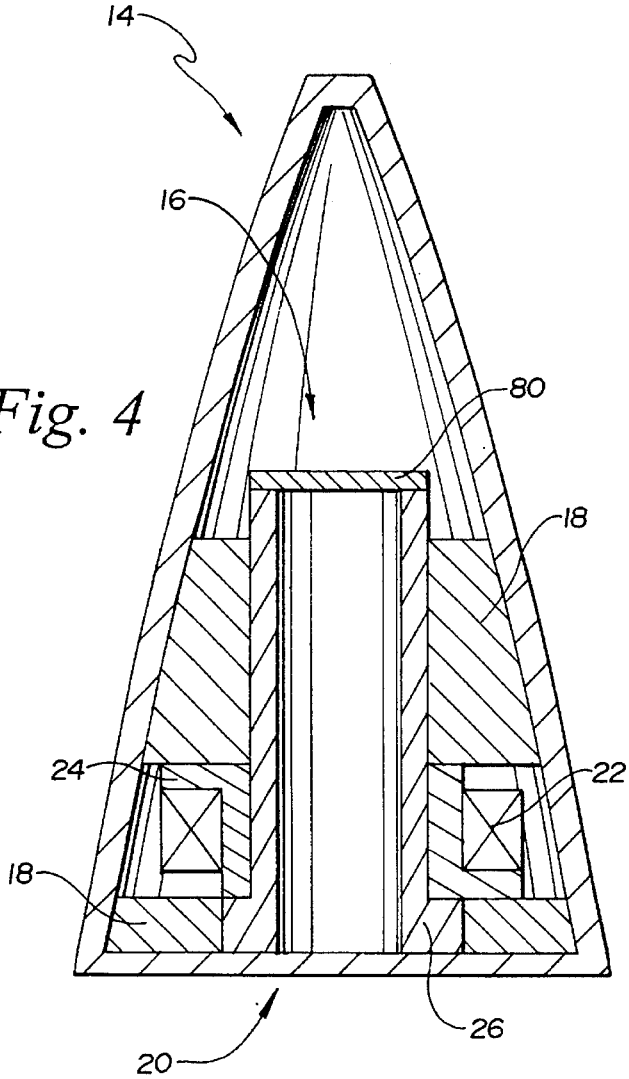
FIG. 4 is a cross section of the nose element of a projectile showing the nose fuze components of the invention.

FIG. 4 shows the nose element 14 of FIG. 3 with a fuze 16. FIG. 4 shows the electronics 18 of the fuze 16 which are necessary for operation, which are well known in the art. In this preferred embodiment, two annular electronics portions are shown, as are well known in the art. This drawing is used to show an example of a fuze layout. Many other configurations of the fuze 16 are known and may be utilized within the spirit of the invention.

Figure 5:
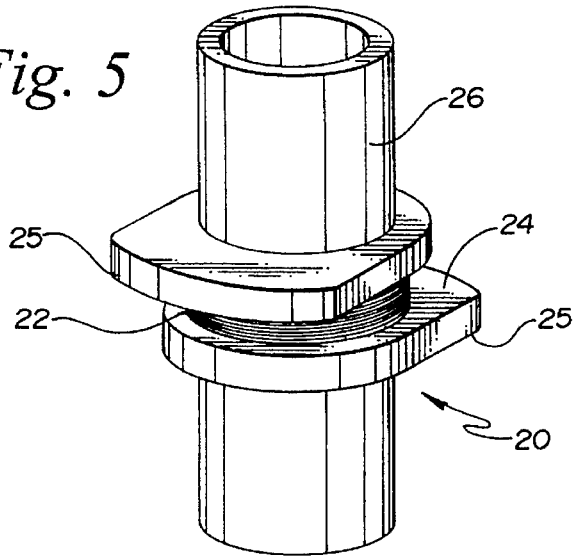
FIG. 5 is a perspective view of the magnetic transducer of the invention.

Referring to FIG. 5, the fuze 16 also includes a magnetic transducer 20. The magnetic transducer includes a single coil 22, a shaped core 24 and a magnet 26. This magnetic transducer 20 receives data from the remote setter (best seen in FIG. 6) and also senses the earth's magnetic field to count turns of the projectile. The inherent axial sensitivity of the coil 22 acts as the receiver for the AC remote set communication waveform (best seen in FIG. 8), introducing both power and data to the fuze. The cylindrical magnet portion 26 of the transducer 20 provides transformer coupling with the setter coil located in block 32 of FIG. 6.

The shape of the transducer core 24 establishes an output signal from coil 22 as the core 24 rotates around its longitudinal axis in an external homogeneous field. When the earth's magnetic field is perpendicular to the spin axis (radial field), the tab-like portions 25 of the core causes magnetic flux to alternate in direction through the coil thereby producing a sine wave voltage. As the alignment angle between the spin axis and the earth's field vector direction changes, the sine wave voltage amplitude decreases with the cosine of the angle. One skilled in the art will recognize that the tabs 25 may be of different shape and size than shown, but still produce the alternating flux path as described herein. Further, the size of the transducer can be adjusted for rounds of different caliber.

The core 24 gives the coil radial sensitivity, allowing monitoring of the earth's field as the projectile spins. The spin signal is in the form of a sine wave. One complete sine wave represents one turn of the projectile. A voltage is generated by the magnetic transducer 20 sensing the time-changing magnetic field of the earth due to projectile spin. The voltage amplitude increases until it peaks at a quarter turn of the projectile and then decreases to zero at the half turn point. The voltage then reverses direction and the amplitude increases to the three quarters turn point and then decreases to zero when one complete turn has been made. Therefore, the zero crossings can be counted. Each turn of the projectile is represented by two zero crossings. One skilled in the art will recognize that known engineering methods may be utilized to count partial turns of the projectile so that the turns count may count quarters of a turn or a partial turn. The spin signal allows for a determination of muzzle velocity as will be described below. The spin signal continues for the total life of the flight of the projectile and provides a means to accumulate a turns count as the basis for air burst prediction in place of, or in conjunction with a time prediction. Although a search coil magnetometer has been described herein, it should be understood that other magnetometers may be utilized.

Figure 6:
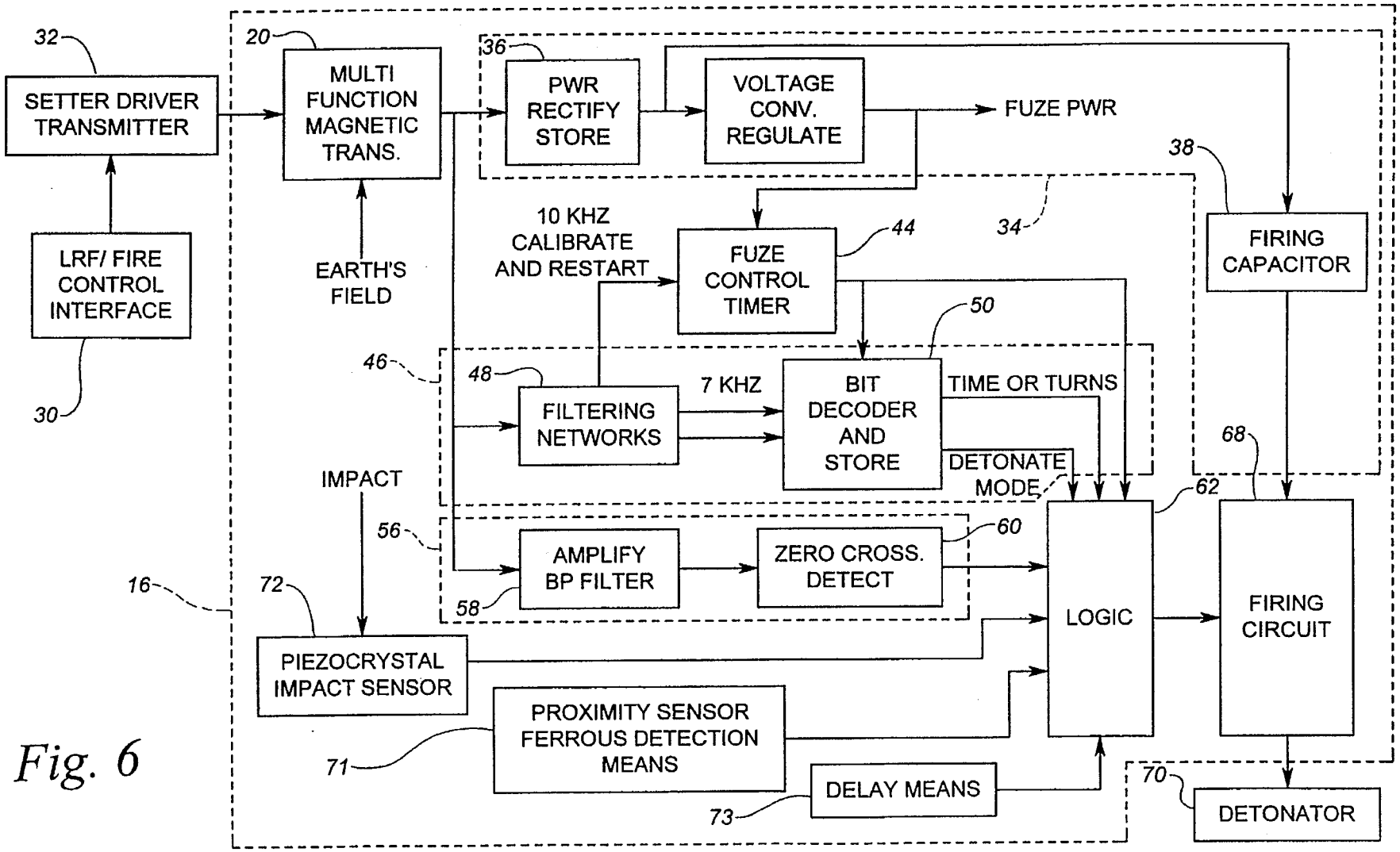
FIG. 6 is a block diagram of the invention.

Referring to FIG. 6, a block diagram of a weapons system including the invention is shown. Block 30 represents the Fire Control System of a gun (not shown) which fires the projectile 5 including the fuzing system of the invention. The fire control system 30 is attached to or is an integral part of the gun and includes appropriate well known circuitry and processors for measuring the range to target of the projectile as desired by an operator. The fire control system 30 also computes the time to burst or turns to burst for the particular projectile based on the target selected by the operator and the known ballistic characteristics of the gun. Fire control systems are known in the art and provide numerous functions and information. The turns to burst count is derived from ballistic characteristics, other parameters and modeling which are known to those skilled in the art. Although derived in the past, the turns to burst count has not been utilized because no known method existed to count the turns of the projectile during flight. The above are provided as examples to explain the invention and should not be considered as limitations of the invention.

Block 32 represents the remote setter or fuze setter.. This device is known in the art and provides for power-up of the fuze and also transmits the necessary information from the operator to the fuze. The fuze setter 32 is conductively connected to the fire control system 30 in the preferred embodiment. The remote setter 32 may be a remote unit hand held by the user or may be attached to the gun or an integral part of the gun. The fuze setter 32 accesses every round during the gun cycle to provide all communication functions to the fuze 10. The setter 32 is designed to allocate a period while the projectile is in the ram or pre-chamber position for communication. Each round receives the necessary exposure while the previous round is being fired.

A typical setter 32 includes two coils (not shown) arranged so as to be closely coupled to the fuze nose element while the round is in the ram position. The coils are arranged to additively drive their leakage flux (flux outside the setter's coils) down the axis of the nose element 14 of the projectile 5 to the magnetic transducer 20. The setter 32 is inductively coupled to the fuze 10 of the projectile 5 and acts as a transmitter. The setter 32 must communicate information to the fuze 10. At a minimum, the information for a bursting round will contain a parameter representing range, i.e. turns to burst, time interval or a combination of both. The setter 32 may also pass information including mode settings and error compensation data. In this manner, a variety of functions or modes can be selected or prioritized individually in each round.

Figure 8:
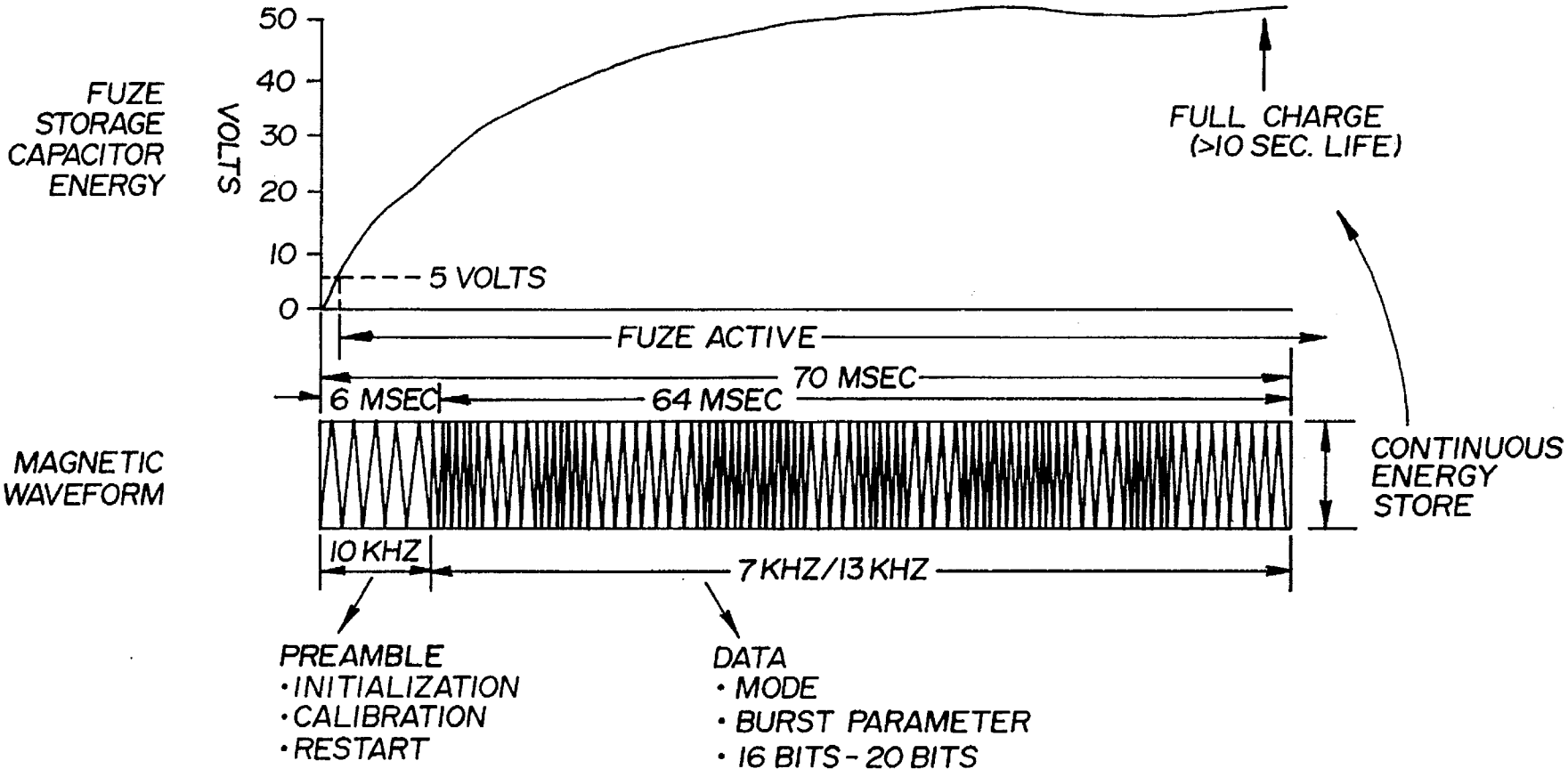
FIG. 8 is a graph illustrating the power up and message period for the invention.

The communication is shown in FIG. 8 where the power-up and message period communicated to each fuze 16 from the setter 32 is depicted. The magnetic waveform received at the magnetic sensor 20 is a large peak to peak signal, in the preferred embodiment 40–50 volts in amplitude. The relatively high voltage allows for high energy storage on a capacitor 36 (shown in FIG. 6) and is also used to charge another capacitor 38 (shown in FIG. 6) in the base element specifically reserved for firing the detonator. The detonator capacitor 38 conserves fuze reliability in cases where the power storage capacitor 36 drains too low. By this means, all fuze electronic circuits are individually powered.

Simultaneous with the storage of fuze power is the communication of calibration data and parameter data. An initial preamble of an accurate burst of 10 Khz is modulated at the beginning of the waveform to create a start signal, and is used in the fuze to quick-lock its own internal time base to the accurate 10 kHz standard from the fire control electronics 30. Therefore, any algorithms or parameter measurements requiring accurate timing are available in the fuze electronics without an accurate internal time-base reference.

Following the 10 kHz preamble are frequency shift modulated signals of 7 kHz or 13 kHz referenced to the 10 kHz which represent digital (bits) 1's and 0's. Up to twenty bits can be communicated to the fuze 16 in this message format to include data for burst, error compensation direction and mode settings, and time delays if desired. Eleven bits will allow parameter measurement to an accuracy greater than 0.1% and 9 bits remain for other functionality and future growth. It should be understood that the frequencies used for the preamble and to represent 1's and 0's, as well as the number of bits transmitted can be varied as desired.

The magnetic transducer configuration 20 serves several functions and allows for several functions to be performed within the fuze 16 without specific on-axis positioning. The magnetic transducer 20 acts as a receiver where information is inductively communicated to the fuze 10. Referring again to FIG. 6, the power storage and supply 34 of the fuze is shown. The fuze 10 must have a power supply 34 to function. The inductive coupling of the transducer 20 to the fuze setter 32 allows large voltages to be transferred from the setter to the fuze 10, as discussed above. In this manner, the fuze 10 is powered.

Figure 7:
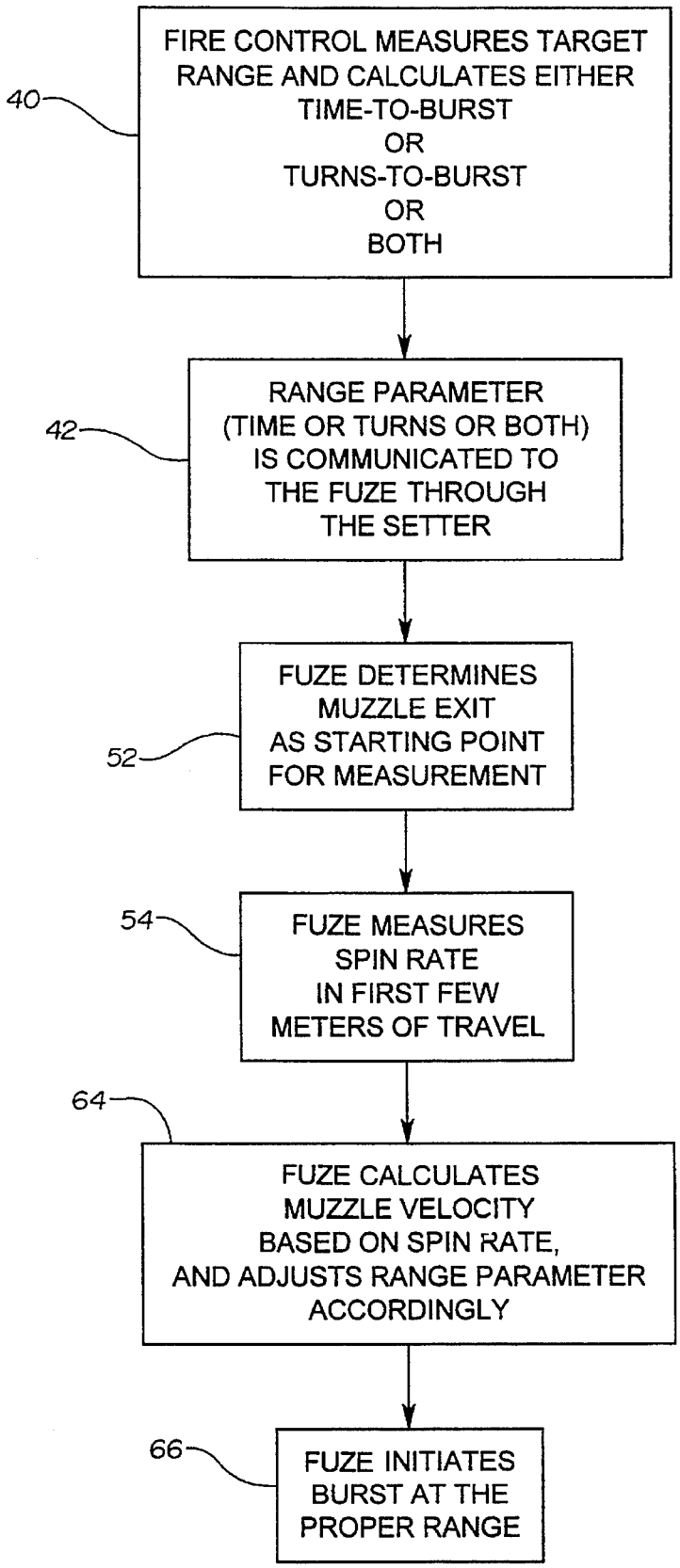
FIG. 7 is a block diagram of the algorithm for determining muzzle velocity.

Referring to FIG. 7, a top level algorithm of the invention is depicted. FIGS. 7 and 6 will be discussed in tandem. Block 40 represents the step of utilizing the fire control system 30 to measure target range. The time to burst or turns to burst or both are calculated based on nominal assumed gun and projectile parameters. Block 42 represents the step of communicating data including the range parameter of block 40 through the setter 32 to the transducer 20. This is done when the user operates the trigger, followed by insertion of the round into the chamber and firing the round. The fuze 16 includes communication circuitry 46. This circuitry 46 includes filtering networks 48 and bit decode and store capabilities 50 which decodes the parameters communicated to the fuze 16 and passes them to logic processor 62. The clock or timer 44, shown in FIG. 6, is also calibrated. Fuze modes, such as point detonate delay mode, air burst, standoff detonate, super quick point detonate, etc. which are well known, are also communicated to the fuze 16 at this point. Prioritization of fuze modes may also be communicated to the fuze 16.

Once data has been communicated to the fuze 16, muzzle exit is detected. This function is represented by block 52 (shown in FIG. 7). As discussed above, muzzle exit is determined using the transducer 20. The ferrous confinement in the gun barrel shields the transducer from the earth's magnetic field and upon exit an abrupt magnetic field transition is generated. The transducer senses this abrupt magnetic field transition and uses this sensing of muzzle exit as the starting point for the countdown to detonation. In other words, at muzzle exit, the time is set to zero and the turns count is set to zero. The count for time-to-burst, turns-to-burst or both is then started.

The muzzle exit signal also serves as a true electronic second environment confirmation, as would be known by those skilled in the art. The signal starts a timer which determines a safe separation distance for the projectile.

After muzzle exit has been determined, the spin rate is measured as represented by block 54. The spin rate is measured in the first few meters of travel. In order to measure spin rate the number of turns must be counted. Referring now to FIG. 6, block 56 of the fuze 16 counts turns. The turns are sensed by the transducer as described earlier. The signals are amplified and filtered 58 and the zero crossings are detected at 60 which drives logic 62 where the turns are counted. The time, time and/or turns to burst, and fuze mode are also input to the logic processor 62.

The ballistic spin relationship is as follows:

$$\text{GunBarrelPitch} = P = \frac{N}{X} = \frac{\text{Turns}}{\text{Feet}} = C$$

C is a constant set by the barrel rifling (Advance ratio).

$$N = \text{totalturns} = \int \frac{dn}{dx}\, dx = \int \left( \frac{dn}{dt} \quad \frac{dt}{dx} \right) dx$$

-continued $$\text{However, } \frac{dn}{dt} = \frac{\text{turns}}{\text{sec}} = \frac{\text{rad}}{\text{sec}} = w_s$$

and $$\frac{dt}{dx} = \frac{1}{\text{muzzlevelocity}} = \frac{1}{V}$$

$$N = \int \frac{w_s}{V}\, dx = \frac{w_s X}{V}$$

$$\frac{N}{X} = \frac{w_s}{V} = C$$

$$w_s = CV$$

Therefore, spin rate =CV or the magnetometer measured spin signal is directly proportional to, and can be used to measure the actual muzzle velocity. In other words, knowing that the projectile will turn a predetermined number of times per unit distance, the number of turns over a measured time allows calculation of the actual muzzle velocity.

Referring again to FIG. 7, block 64 represents the calculation of the muzzle velocity based on spin rate. The muzzle velocity is calculated by the logic processor 62. At this point, block 64 also adjusts the range parameter based on the muzzle velocity calculation. This function is performed by logic processor 62. The time-to-burst or turns-to-burst may be adjusted. The logic processor 62 includes look up tables or data which, based on the actual velocity, indicates the adjustment to the time or turns. This adjustment is designed for each gun/round combination and effectively compensates for the nonlinearity discussed above and shown in FIG. 1. Such an adjustment could be implemented using a look-up table methodology based on test results and modeling. In its most simple form, the table would be entered with the actual velocity and a corresponding turns correction number would be read out, where the correction number is based on the difference between the turns to burst for the nominal velocity and the turns to burst for the actual velocity. A more complicated version of the look-up table could incorporate different parameters such as angle of firing which is relevant to artillery guns and rounds and tank guns and rounds. Other projectile and gun parameters could easily be incorporated into a modified look-up table where the only limitations are the amount of memory (dictated by projectile size) available and the testing and modeling that is desired to be undertaken. As one skilled in the art knows, the amount of testing needed is limited by known modeling techniques.

The final step is illustrated by block 66. The fuze initiates burst at proper range in block 66. The signal is transmitted from the logic processor 62 to the firing circuit 68. The firing circuit 68 is conductively connected to the detonator 70 for detonation of the projectile.

The magnet 26 of the transducer 20 (best seen in FIG. 6) provides a short range armor proximity function for warhead standoff or hard/soft target differentiation by virtue of the target ferrous properties which forms a time varying magnetic circuit reluctance. The ferrous nature of a target, such as a tank, initiates a distinct high frequency (dH/dt) signal which can be categorized as a short range proximity sensor (proximity sensor/ferrous defection means 71). This signal is enhanced at short ranges by the permanent magnet "bias" field which is significantly stronger than either the targets induced or permanent signature. Therefore, a warhead may be predetonated at a short distance from the target or before target impact using this short range containment feature. An additional function is inherent from the standoff signal. If no short standoff signal has occurred just prior to impact, the fuze can then, in effect, differentiate between a heavy ferrous target and lighter composite or non-metallic targets such as a bunker. The heavy ferrous target is categorized as hard and the light composite target as soft. In general, short standoff (shaped charge) warhead detonation is desired for hard targets and a delayed detonation after impact is desired for soft targets.

The impact sensor 72 is used to cause the projectile to detonate if it impacts a target prior to the generation of a "hard target" detonation signal by the electronics in fuze 16. In a preferred embodiment, a piezo crystal is utilized for this function. This function is commonly referred to as the point detonate function. Another means for accomplishing this non-hard target impact function is the use of a flyer disk 80 (shown in FIG. 4). The thin flyer disk is held to the from of the transducer magnet. Upon impact, this disk would inertially release and by magnetic physics effects produce an easily recognizable (dH/dt) signal. Yet another approach is with the magnet itself. The magnet can be designed, by its composition, to change magnetization at the shock level of impact, thereby producing an appropriate signal. All of these impact sensor functions can be used in combination with the timer to achieve delay point detonation (delay means 73). The specific electronics and designs to achieve these functions are well known in the art.

One skilled in the art would also realize that a combination of turns only, time only, turns then time, or time then turns modes of operation could be easily implemented using the inventive fuze. The time function may also be utilized for a self destruct mode.

The above Examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. Apparatus for counting each rotation of a projectile, after firing the projectile from a firing weapon, the projectile having a longitudinal axis, said apparatus comprising:

(a) counting means for counting each said rotation of the projectile as it rotates around its longitudinal axis, the counting means comprising:

(i) spin signal means for generating a spin signal which varies over time as the projectile rotates about its axis in the earths magnetic field and where the magnitude of the spin signal reaches a predetermined threshold a predetermined number of times for each said rotation of the projectile;

(ii) a counter operatively connected to the spin signal means for counting the number of times the spin signal reaches its predetermined threshold;

(b) spin rate computation means for determining a spin rate of the projectile, wherein the spin rate computation means is comprised of timing means operatively connected to the counter for determining the time for the projectile to rotate a predetermined number of times; and (c) muzzle velocity computing means for determining actual muzzle velocity based on a barrel pitch constant of the firing weapon and the spin rate of the projectile.

2. The apparatus of claim 1 wherein the spin signal is sinusoidal and where the predetermined threshold magnitude is zero, and where the zero threshold is crossed twice for each complete rotation of the projectile whereby each complete rotation generates one wavelength of the sinusoidal spin signal.

3. The apparatus of claim 1 wherein the spin signal means comprises a magnetic transducer including a conductive winding coil and a core through which the earths magnetic field generates a time varying signal as the projectile rotates.

4. The apparatus of claim 1 further comprising:

(a) detonation means; and (b) receiver means for inductively receiving a turns-to-burst range parameter prior to the projectile exiting the firing weapon, wherein the turns-to-burst range parameter is based in part on a nominal muzzle velocity parameter, and where the detonation means is activated when the counter indicates that the projectile has rotated a number of times equal to the turns-to-burst range parameter.

5. The apparatus of claim 4 further including adjustment computing means for adjusting the turns-to-burst range parameter based on the actual determined muzzle velocity, wherein the detonation means detonates the projectile when the projectile has reached the adjusted turns-to-burst range parameter, whereby the accuracy of the detonation is increased.

6. The apparatus of claim 5, wherein a time interval range parameter is received by the receiving means in addition to the turns-to-burst range parameter, and wherein the projectile utilizes the counter over a first predetermined portion of the projectile trajectory and wherein the projectile utilizes the time interval over a second predetermined portion of the projectile trajectory.

7. The apparatus of claim 6 wherein the projectile utilizes the counter for the first 1000 meters and utilizes the time interval thereafter until projectile detonation.

8. A magnetic sensor system for use with a fuze of a projectile fired from a gun where the projectile spins about its longitudinal axis, comprising:

(a) an inductive transmitter;

(b) a receiver inductively connected to the transmitter for receiving a turns-to-burst turns count from the transmitter;

(c) spin signal means for generating a time changing spin signal based on the projectile rotation in the earths magnetic field, conductively connected to the receiver where the signal is sensed for each turn of the projectile;

(d) counting means for counting the turns of the projectile operatively connected to the spin signal means; and (e) detonation means conductively connected to the counting means for detonating the projectile when the turns-to-burst turn count has been reached.

9. The sensor system of claim 8 further including computing means operatively connected to the counting means for determining the actual muzzle velocity of the projectile based on the turns counted and a barrel pitch constant of the gun, wherein the computing means comprises a timer connected to the counting means for determining the time for a projectile to spin a predetermined number of times.

10. The sensor system of claim 9 further including compensating means operatively connected to the computing means for adjusting the turns count, which is based in part on a nominal assumed muzzle velocity, for the difference between the nominal assumed muzzle velocity and the actual muzzle velocity.

11. The sensor system of claim 9 wherein a time interval range parameter is received by the receiver and further including time interval counting means for storing the time interval range parameter which is operatively connected to a timer such that the time interval counting means decrements the time interval range parameter at a regular predetermined time interval whereby the detonation means detonates the projectile when the time interval range parameter has been decremented to zero.

12. The sensor system of claim 11 wherein the projectile utilizes the counting means over a first predetermined portion of the projectile trajectory and wherein the projectile utilizes the time interval range parameter over a second predetermined portion of the projectile trajectory.

13. The sensor system of claim 8 wherein the receiver receives a data carrying signal and where the sensor system includes a capacitor operatively connected to the receiver which is charged when the projectile receives the data carrying signal and which is used to provide power for the fuze after firing.

14. The sensor system of claim 8 further comprising a proximity sensor for sensing ferrous objects a predetermined distance from the projectile operatively connected to the detonation means for detonating the projectile regardless of whether the turns to burst count has been reached.

15. The sensor system of claim 8 further comprising an impact sensor operatively connected to the detonation means for detonating the projectile at impact with a target regardless of whether the turns to burst count has been reached.

16. The sensor system of claim 15 further comprising delay means operatively connected to the detonation means for delaying the detonation of the projectile for a predetermined time period.

17. The sensor system of claim 15 further comprising ferrous detection means for differentiating between a target which is substantially ferrous and a target which is substantially non-ferrous, operatively connected to the detonation means wherein the projectile detonates on impact if a substantially ferrous target is detected and detonates after a predetermined delay if a substantially non-ferrous target is detected.

18. A weapons system comprising:

(a) a projectile having a longitudinal axis;

(b) means for firing the projectile, the means causing the projectile to spin around its longitudinal axis, where the projectile will spin a predetermined number of turns per unit distance based on a barrel pitch constant inherent to the means for firing;

(c) the projectile having a sensor through which the earths magnetic field generates a voltage once the projectile exits the means for firing;

(d) projectile spin count means connected to the sensor for counting the number of times the projectile spins around its longitudinal axis;

(e) detonation means for detonating the projectile when the projectile has reached a predetermined spin count; and (f) spin rate computation means for determining a spin rate of the projectile, wherein the spin rate computation means is comprised of timing means operatively connected to the projectile spin count means for determining a time for the projectile to spin a predetermined number of times.

19. The projectile of claim 18 further including computing means for determining actual velocity based on the barrel pitch constant and the spin rate of the projectile.

20. The projectile of claim 19 wherein the projectile includes receiver means for inductively receiving a turns-to-burst range parameter prior to the projectile exiting the means for firing, wherein the turns-to-burst range parameter is based in part on a nominal velocity parameter.

21. The projectile of claim 20 further including computing means for adjusting the turns-to-burst range parameter based on the actual determined velocity, wherein the detonation means detonates the projectile when the projectile has reached the adjusted turns-to-burst spin count, whereby the accuracy of the detonation is increased.

22. The projectile of claim 21 wherein a time interval range parameter is received by the receiving means in addition to the turns-to-burst range parameter, and wherein the projectile utilizes the projectile spin count over a first predetermined portion of the projectile trajectory and wherein the projectile utilizes the time interval range parameter over a second predetermined portion of the projectile trajectory.

23. The projectile of claim 22 wherein the projectile utilizes the projectile spin count for the first 1000 meters and utilizes the time interval range parameter thereafter until projectile detonation.

24. A method for determining the muzzle velocity of a projectile, after firing the projectile from a firing weapon, the projectile having a longitudinal axis, the steps comprising:

(a) counting each rotation of the projectile as it rotates around its longitudinal axis, wherein the step of counting further includes generating a spin signal which varies over time as the projectile rotates about its axis in the earths magnetic field and where the spin signal reaches a predetermined threshold a predetermined number of times for each rotation of the projectile, whereby a rotation is counted when the spin signal means reaches its threshold the predetermined number of times;

(b) computing a spin rate of the projectile, wherein the step of computing the spin rate further comprises timing the time for the projectile to rotate a predetermined number of times; and (c) computing a muzzle velocity based on a barrel pitch constant of the firing weapon and the spin rate of the projectile.

* * * * *